United States Patent [19]

Butterwick

[11] Patent Number: 4,633,076

[45] Date of Patent: Dec. 30, 1986

[54] INTENSIFIED CHARGE-COUPLED IMAGE SENSOR HAVING A HEADER ASSEMBLY WITH AN ECCENTRICALLY DISPOSED CCD SUPPORT ASSEMBLY THEREIN

[75] Inventor: Gilbert N. Butterwick, Upper Leacock Township, Lancaster County, Pa.

[73] Assignee: RCA Corporation, Princeton, N.J.

[21] Appl. No.: 705,722

[22] Filed: Feb. 26, 1985

[51] Int. Cl.[4] ..... H01J 31/50

[52] U.S. Cl. ..... 250/213 VT; 313/540

[58] Field of Search ..... 250/213 R, 213 VT, 207, 250/332, 578; 357/24 LR, 32; 313/523, 531, 540, 528

[56] References Cited

U.S. PATENT DOCUMENTS

| | | | |
|---|---|---|---|
| 3,290,171 | 12/1966 | Zollman et al. | 117/160 |
| 3,887,810 | 6/1975 | Skaggs | 250/213 VT |
| 4,266,334 | 5/1981 | Edwards et al. | 29/583 |
| 4,355,229 | 10/1982 | Zimmerman et al. | 250/213 VT |
| 4,465,549 | 8/1984 | Ritzman | 156/630 |
| 4,555,731 | 11/1985 | Zinchuk | 250/213 VT |

*Primary Examiner*—David C. Nelms

*Attorney, Agent, or Firm*—Eugene M. Whitacre; Dennis H. Irlbeck; Vincent J. Coughlin, Jr.

[57] ABSTRACT

An intensified charge-coupled image sensor has a longitudinally extending optical axis. The image sensor comprises an image intensifier section and a header assembly. The image intensifier section includes an envelope having a photoemissive cathode therein for emitting photoelectrons in a pattern corresponding to the intensity of radiation incident thereon. The header assembly includes a charge-coupled device for receiving the photoelectrons from the cathode, an insulative header and a header flange attached between the insulative header and the image intensifier section. The header assembly is improved by the inclusion of an annular support flange which is coaxially disposed within the header flange. The support flange has a projection that abuts the insulative header. A charge-coupled device support assembly is eccentrically disposed within and attached to the annular support flange. The support assembly includes a lower support member and an upper tensioning member for tensioning the charge-coupled device and for exposing at least a portion of the device to the photoelectrons from the cathode through an aperture formed in the upper tensioning member. The exposed portion of the charge-coupled device is centered about the optical axis of the image sensor.

2 Claims, 5 Drawing Figures

INTENSIFIED CHARGE-COUPLED IMAGE SENSOR HAVING A HEADER ASSEMBLY WITH AN ECCENTRICALLY DISPOSED CCD SUPPORT ASSEMBLY THEREIN

BACKGROUND OF THE INVENTION

The present invention relates to an intensified charge-coupled image sensor and particularly to a header assembly for such a sensor that utilizes a plurality of low cost metal parts which securely retain and locate a charge-coupled device (CCD) relative to the optical axis of the sensor.

An intensified charge-coupled image sensor comprises an image intensifier section having a photoemissive cathode on an interior surface of an input window and a header assembly having a charge-coupled device (CCD) located at the focal plane of the image sensor. Such a structure is shown in U.S. Pat. No. 4,355,229 issued to H. S. Zimmerman et al., on Oct. 19, 1982, and assigned to the assignee of the present invention. The Zimmerman et al. patent is incorporated by reference herein for the purpose of disclosure. The CCD described in the Zimmerman et al. patent, and shown herein in FIGS. 1 and 2, includes an image array 10, known as an A register, a temporary storage array 12, known as a B register, and an output register 14, known as a C register. The B and C registers are usually masked, that is, mean (not shown) are provided for preventing photoelectrons from the photoemissive cathode from reaching either register.

The A and B registers have channel stops (not shown) extending in the column direction to isolate the channels (the columns of the CCD) from one another. The electrodes (shown in FIG. 2) may be of the single layer type comprising, for example, N+ type regions of polysilicon separated by P-type regions of polysilicon. These electrodes extend in the row direction and, in the example illustrated, are three-phase operated. The electrodes are insulated from the relatively thick P-type substrate by a layer of silicon dioxide ($SiO_2$). The CCD mentioned above has 320 columns and 512 rows (256 in the A register and 256 in the B register), each row comprising a group of three electrodes.

The operation of the CCD of FIG. 1 is well understood. During the so-called integration time, a scene or other image is projected directly onto the A register. However, in an intensified charge-coupled image sensor, such as that shown in FIG. 3, the scene is projected onto the photoemissive cathode and photoelectrons released therefrom in a pattern corresponding to the intensity of the radiation incident on the cathode impinge upon the A register of the CCD. The incident photoelectrons cause charges to be produced at the various locations of the A register in accordance with the energy density reaching the respective locations.

Upon the completion of the integration time (e.g., during the vertical blanking interval of commercial television), the charge signals which have accumulated (a "field") are transferred, in parallel, in the column direction from the A to the B register by the application of the multiple phase voltages $\phi_{A1} \ldots \phi_{A3}$ and $\phi_{B1} \ldots \phi_{B3}$. The charges subsequently are transferred a row at a time, from the B register to the C register, and after each row of charges reaches the C register, it is serially shifted out of the C register in response to the shift voltages $\phi_{C1} \ldots \phi_{C3}$. The transfer of charges from the B to the C register occurs during a relatively short time (the horizontal blanking time of commercial television, which is about 10 μs) and the serial shifting of the C register occurs at relatively high speed (during the horziontal line display time of commerical television. During the transfer of a field from the B to the C register, a new field may be integrated in the A register.

When a CCD is used in an intensified charge-coupled image sensor, it is necessary to thin the substrate, at least in the A register to a thickness of about 10μ (microns) to minimize lateral dispersion of the charge produced by the incident photoelectrons. One method for thinning a single large wafer containing a large number of CCD's is disclosed in U.S. Pat. No. 4,266,334 issued to T. W. Edwards et al. on May 12, 1981, and incorporated by reference herein for the purpose of disclosure. The Edwards et al. patent utilizes a glass plate which is laminated or glued onto the thinned surface of the wafer to add structural support during testing and removal of the individual CCD's from the large wafer. The glass support plate must, however, be delaminated or otherwise removed from the wafer before the CCD's contained therein can be used in an intensified charge coupled image sensor. The glue used to affix the glass plate to the CCD is incompatible with the formation of the photoemissive cathode formed on the interior surface of the input window of the image intensifier section of the image sensor, and the glass window also attenuates the photoelectrons from the cathode thereby preventing them from impinging upon the A register of the CCD.

U.S. Pat. No. 4,465,549 issued to I. G. Ritzman on Aug. 14, 1984, and assigned to the assignee of the present invention, discloses a method of removing the glass support plate from a thinned wafer containing a large number of CCD's. The wafer is subsequently sectioned to provide the individual CCD's. Each of the thinned CCD's has a thickness of about 10u and is too delicate to handle without damage. Thus, copending U.S. patent application Ser. No. 494,288 filed by J. A. Zollman et al. on May 13, 1983, discloses a support frame which is brazed to one surface of a thinned CCD to provide the required rigidity for handling and mounting the CCD within the image sensor. In prior art intensified charge-coupled image sensors, the CCD with the attached frame is brazed to an insulative header. The initial brazing of the frame to the CCD and the subsequent brazing of the frame with the attached CCD to the insulative header has resulted, occasionally, in scrap due to the flow of braze material onto the CCD and to misalignment of the CCD on the insulative header. Alternatively, the CCD is attached to the header by means of spring clips. However, spring clips permit some movement and misalignment of the CCD under severe shock and vibration of the sensor. Accordingly, the need exists for a reliable structure for securing and locating the CCD upon the insulative header without brazing, and for accurately centering the CCD relative to the optical axis of the image sensor.

SUMMARY OF THE INVENTION

An intensified charge-coupled image sensor has a longitudinally extending optical axis. The image sensor comprises an image intensifier section and a header assembly. The image intensifier section includes an envelope having a photoemissive cathode therein for emitting photoelectrons in a pattern corresponding to the intensity of radiation incident thereon. The header assembly includes a charge-coupled device for receiving the photoelectrons from the cathode, an insulative header and a header flange attached between the insulative header and the image intensifier section. The header assembly is improved by the inclusion of an annular support flange which is coaxially disposed within the header flange. The support flange has a projection that abutts the insulative header. A charge-coupled device support assembly is eccentrically disposed within and attached to the annular support flange. The support assembly includes means for tensioning the charge-coupled device and for exposing at least a portion of the device to the photoelectrons from the cathode. The exposed portion of the charge-coupled device is centered about the optical axis of the image sensor.

DETAILED DESCRIPTION OF THE PREFERRED EMBODIMENT

Figure 3:
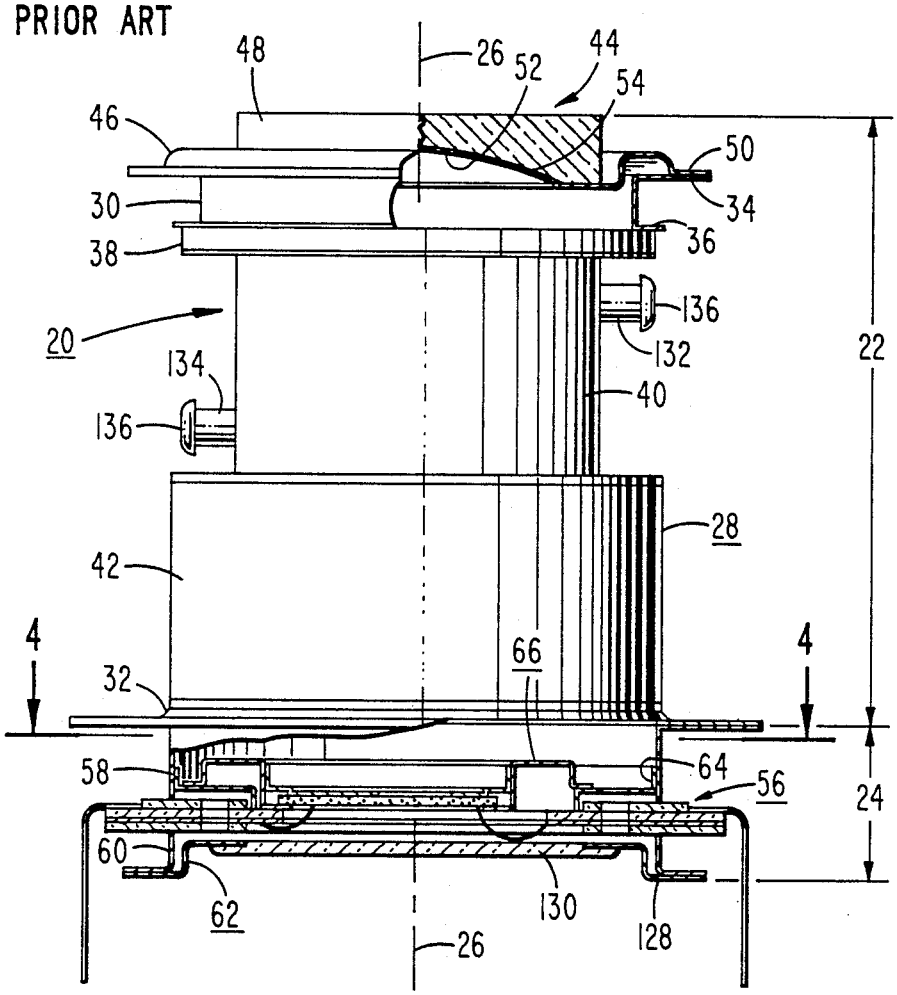
FIG. 3 is an elevational view, partially in section, of an intensified charge-coupled image sensor embodying a novel header assembly according to the present invention.

An intensified charge-coupled image sensor 20 is shown in FIG. 3. The image sensor 20 comprises an inverter image intensifier section 22 and a header assembly 24. An optical axis, 26, extends longitudinally along the center line of the sensor 20.

The image intensifier section 22 comprises a substantially cylindrical vacuum envelope 28 which may be of glass-metal or ceramic-metal construction. For maintaining close dimensional tolerances, ceramic-metal construction is preferred. The envelope 28 includes a conductive annular input faceplate flange 30 at one end and a conductive annular envelope header flange 32 at the other end. The input faceplate flange 30 has a substantially flat, radially extending weld lip 34 and a substantially flat, radially extending bulb sealing surface 36. A cylindrical insulating spacer 38, preferably of a high alumina ceramic material, is attached, for example by brazing, to the sealing surface 36 of the input faceplate flange 30. The opposite end of the insulating spacer 38 similarly is attached to one end of a grid bulb flange 40. An anode insulating spacer 42, also formed from a high alumina ceramic material, is attached, for example by brazing, between the other end of the grid bulb flange 40 and the envelope header flange 32.

An input faceplate assembly 44 closes one end of the envelope 28. The input faceplate assembly 44 includes a cathode faceplate flange 46 and a cathode faceplate 48. The cathode faceplate 48 preferably comprises a fiber optic member, as is known in the art, that is frit sealed by conventional means to the cathode faceplate flange 46. The cathode faceplate flange 46 includes a radially extending portion 50, which is welded around its periphery to the weld lip 34 of the input faceplate flange 30. A photoemissive cathode 52 is formed on an interior surface 54 of the cathode faceplate 48. As herein described, the image intensifier section 22 is conventional. A more complete description of the image intensifier section is contained in U.S. Pat. No. 4,355,229 issued to Zimmerman et al. and referenced herein.

Figure 4:
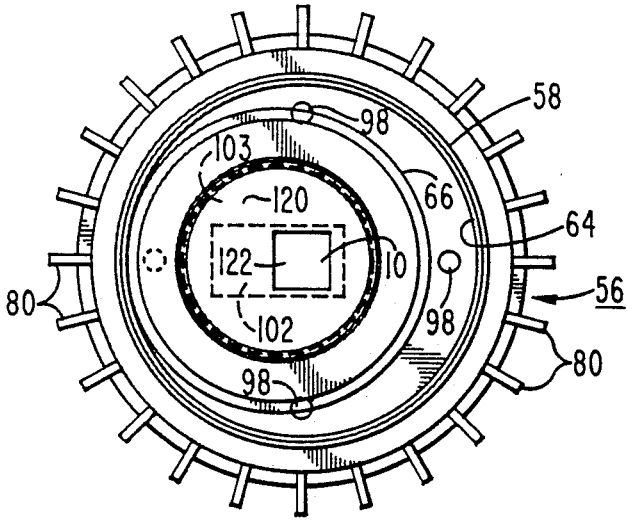
FIG. 4 is a plan view of the novel header assembly taken along line 4—4 of FIG. 3.
Figure 5:
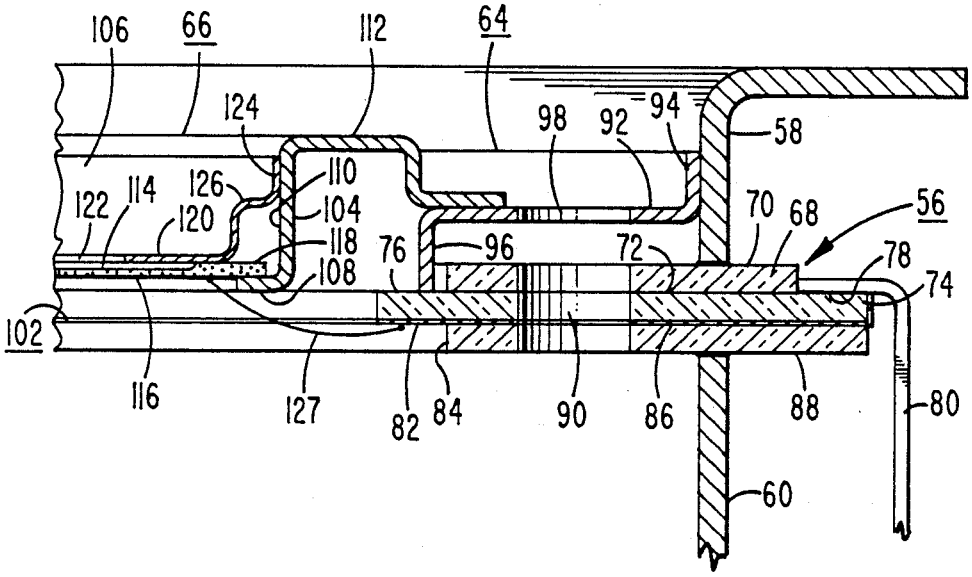
FIG. 5 is an enlarged cross-sectional view of a fragment of the novel header assembly.

The novel header assembly 24, shown in FIGS. 3, 4 and 5, comprises, in combination, an annular insulative header 56, a first conductive header flange 58, a second conductive header flange 60, a window assembly 62, a conductive annular support flange 64 coaxially disposed within the first header flange 58 and a charge-coupled device support assembly 66 which is located at the focal plane of the image sensor.

As shown in FIGS. 3 and 5, the annular insulative header 56 comprises a plurality of insulative layers formed by a lamination and sintering process that provides a strong, hermetic, dimensionally stable and thermally inert member. The process is known in the art and need not be described in detail. Alternatively, the header may be formed of a plurality of ceramic components that are bonded together by a suitable medium. With particular reference to FIG. 5, the header 56 comprises a substantially flat first annular ceramic disc 68 having a first surface 70, which is designated as the first major surface of the header 56, and an opposed flat disc surface 72 which is joined to a substantially flat second annular ceramic disc 74. The inside diameter of the second disc 74 is less than the inside diameter of the first disc 68 and produces a support surface 76. Also, the outside diameter of the second disc 74 is greater than the outside diameter of the first disc 68 thereby forming a lead sealing surface 78. A plurality of radially extending electrical leads 80 are attached, for example, by brazing, to the lead sealing surface 78 of the second disc 74. The leads 80 are then formed to extend longitudinally along the image sensor 20 to facilitate electrical connection thereto. The reverse surface of the second disc 74 is metallized with a plurality of discrete, radially extending electrode pads 82 (only one of which is shown in FIG. 5) to form an electrode surface. Each of the pads 82 also extends longitudinally along the peripheral surface of the second disc 74 and contacts a different one of the leads 80. A substantially flat third annular ceramic disc 84 having a first surface 86 and a second surface 88 is joined to the second disc 74 so that the first surface 86 of the third disc 84 is bonded to the electrode surface of the second disc 74. The second surface 88 of the third disc 84 is designated as the second major surface of the header 56. The inside diameter of the third disc 84 is less than the inside diameter of the second disc 74 so that the electrode pads 82 around the inner periphery of the second disc 74 are exposed. The outside diameter of the third disc 84 is, however, substantially equal to that of the second disc 74, thereby covering and protecting the radially disposed portions of the electrode pads 82 adjacent to the outside of the second disc 74. At least a portion of each of the first and second major surfaces 70 and 88 of the header 56 are also metallized to facilitate sealing to the first and second header flanges 58 and 60, respectively. The method of metallizing is described in detail in U.S. Pat. No. 3,290,171, issued to J. A. Zollman et al. on Dec. 6, 1966, which is incorporated by reference herein for the purpose of disclosure. A plurality of pressure relief apertures 90 are provided through the header 56 inward from the first and second header flange 58 and 60 for a reason to be disclosed hereinafter.

The conductive annular support flange 64 is coaxially disposed within the first conductive header flange 58. The support flange 64 includes a substantially flat support flange surface 92 disposed between a substantially orthogonal sidewall portion 94 which contacts and is affixed to the inside surface of the first header flange 58, and an oppositely directed, substantially orthogonal, support projection 96 which abutts the support surface 76 of the second disc 74 of the header 56. A plurality of support flange pressure relief apertures 98 are formed through the support flange surface 92 of the support flange 64.

Figure 1:
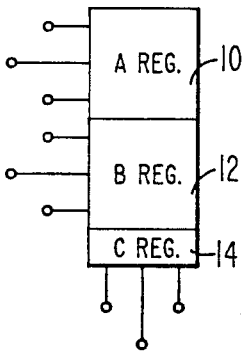
Fig. 1 PRIOR ART
FIG. 1 is a schematic representation of a known charge-coupled device (CCD) imager of the field transfer type.
Figure 2:
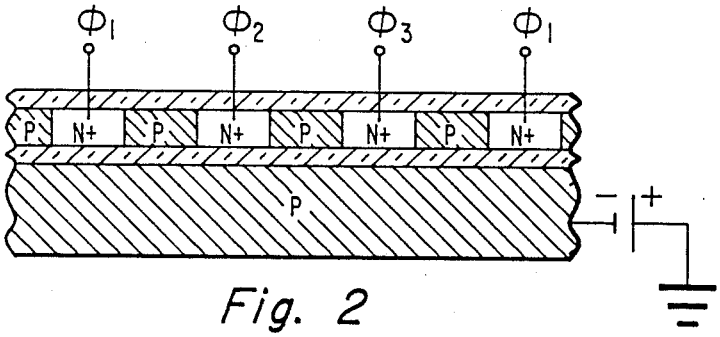
Fig. 2 PRIOR ART
FIG. 2 is a section through the imager of FIG. 1 showing the electrode structure.

The charge-coupled device support assembly 66 is eccentrically disposed within and attached to the flat support flange surface 92 of the annular support flange 64. The charge-coupled device support assembly 66 supports and tensions a charge-coupled device (CCD) 102 which, preferably, is formed on a disc-shaped silicon wafer 103 as described in my copending patent application, filed concurrently herewith, and entitled, Intensified Charge-Coupled Image Sensor Having a Charged-Coupled Device with Contact Pads on an Annular Rim Thereof. The support assembly 66 includes an annular lower support member 104 and an annular upper tensioning member 106. The upper tensioning member 106 is nested within the lower support member 104. The lower support member 104 includes an annular support ring portion 108 and an upright skirt portion 110 extending substantially normal to the outer edge of the support ring portion 108. A step-like weld flange 112 extends radially outwardly from the skirt portion 110. The CCD 102 includes a first CCD surface 114 and a second CCD surface 116 which has a plurality of electrodes and contact pads (not shown) thereon to facilitate operating the charge-coupled device 102. The CCD 102 has been thinned, at least in the A register of imaging array 10, to a thickness of 10μ (microns). An integral rim portion 118 extends arounds the thinned portion of the first surface 114 of the CCD 102. The CCD 102 is disposed within the lower support member 104 so that the periphery of the second surface 116 is in contact with the support ring portion 108 of the lower support member and the CCD 102 lies in a plane substantially orthogonal to the optical axis 26. The upper tensioning member 106 includes a substantially flat contact portion 120 having a substantially rectangular aperture 122 formed therethrough. A cylindrical wall portion 124 is connected to the flat contact portion 120 by a step-like transition portion 126. With the upper tensioning member 106 nested within and attached to the lower support member 104, the flat contact portion 120 of the tensioning member abutts the rim portion 118 of the first surface 114 of the CCD 102 between the thinned portion of the device 102 and the periphery of the rim portion. The relative location of the CCD 102 between the upper tensioning member 106 and the lower support member 104 tensions and flattens the CCD 102 to remove any wrinkles therefrom. The upper tensioning member 106 is oriented so that the rectangular aperture 122 exposes the A register or imaging array 10 of the CCD 102 to photoelectrons (not shown) emitted from the cathode 52. As shown in FIG. 1, the imaging array 10 is not centered with respect to the CCD 102. Accordingly, as shown in FIGS. 3 and 4, the center of the CCD 102 is displaced relative to the optical axis 26. The novel configuration of the charge-coupled device support assembly 66 permits the eccentric mounting of the support assembly 66 within the annular support flange 64 so that the center of the imaging array 10, framed by rectangular aperture 122, can be centered about the optical axis 26 of the image sensor 20. The novel configuration of the support assembly 66 and the annular support flange 64 utilize tool-formed parts with circular symmetry to keep parts cost low, while permitting precision alignment of the imaging array 10 with the optical axis 26. Once aligned, the step-like weld flange 112 of the lower support member 104 of the support assembly 66 is welded to the flat support flange surface 92 of the annular support flange 64. A plurality of wires 127 are bonded between the contact pads on the second CCD surface 116 and the electrode pads 82 of the header 56.

As shown in FIG. 3, the window assembly 62 closes the other end of the envelope 28. The window-assembly 62 includes a window flange 128 and a glass faceplate 130 sealed to the window flange 128. The window-flange 128 is welded to the second header flange 60 to complete the closure of the envelope 28.

The photoemissive cathode 52 may be one of any number of photoemissive surfaces known in the art. For many applications where extended red response is desirable, a potassium-sodium-cesium-antimony photoemissive cathode is preferred. Briefly, the cathode is formed by baking the image sensor 20 at an elevated temperature for several hours with a copper exhaust tubulation 132 connected to an exhaust system (not shown) for removing occluded gases from the sensor components. The pressure relief apertures 90 and 98 allow the pressure to be equalized on both sides of the CCD 102, thereby preventing damage to the CCD. The tube is then cooled to room temperature at which time the cathode formation and activation process is initiated. The process may, for example, be similar to that described in U.S. Pat. No. 3,658,400 issued to F. A. Helvy on Apr. 25, 1972, and entitled, "Method Of Making A Multialkali Photocathode With Improved Sensitivity To Infrared Light And A Photocathode Mode Thereby." The Helvy patent, assigned to assignee of the present invention, is incorporated by reference herein for the purpose of disclosure. The constituents of the photoemissve cathode 52 are introduced into the sensor 20 through a second copper tubulation 134. Each of the tubulations 132 and 134 are shown as being "tipped-off", i.e. cold welded and covered by a protective cap 136.

What is claimed is:

1. In an intensified charge-coupled image sensor having a longitudinally extending optical axis, said sensor comprising an image intensifier section including an envelope having therein a photoemissive cathode for emitting photoelectrons in a pattern corresponding to the intensity of radiation incident thereon, and a header assembly including a charge-coupled device for receiving photoelectrons from said cathode, an insulative header and a header flange attached between said insulative header and said image intensifier section, wherein the improvement comprising said header assembly including an annular support flange coaxially disposed within said header flange, said support flange having a projection that abutts said insulative header, and a charge-coupled device support assembly eccentrically disposed within and attached to said annular support flange, said support assembly including means for tensioning said charge-coupled device and for exposing at least a portion of said device to photoelectrons from said cathode, said exposed portion being centered about said optical axis.

2. In an intensified charge-coupled image sensor having a longitudinally extending optical axis, said sensor comprising:

(a) An image intensifier section including;

i. An envelope having an input faceplate flange at one end and an envelope header flange at the other end, ii. An input faceplate assembly attached to said input faceplate flange for closing one end of said envelope, and iii. A photoemissive cathode disposed adjacent to said faceplate assembly for emitting photoelectrons in a pattern corresponding to the intensity of the radiation incident thereon, and (b) A header assembly including;

i. An annular insulative header comprising a plurality of insulative layers joined together to form a hermetic, dimensionally stable, thermally inert member, said header having a first major surface, an oppositely disposed second major surface, and a centrally disposed header aperture, said header including an electrode surface having a plurality of discrete electrode pads thereon each of said electrode pads extending between two of the insulative layers to the periphery of said header and then longitudinally along the peripheral surface of one of the layers, each of said electrode pads contacting a different radially extending lead attached to the one insulative layer, ii. A first header flange attached at one end to said envelope header flange and at the other end to said first major surface of said insulative header, iii. A second header flange attached at one end to said second major surface of said insulative header, iv. A window assembly attached to the other end of said second header flange for closing the other end of said envelope, v. An annular support flange coaxially disposed within said first header flange, said annular support flange having a projection that abutts said insulative header, vi. A charge-coupled device (CCD) disposed in a plane substantially orthogonal to said optical axis, said charge-coupled device having a first surface and an oppositely disposed second surface, said second surface having a plurality of electrodes thereon, and vii. A charge-coupled device support assembly eccentrically disposed within and attached to said annular support flange, said support assembly including (1) An annular lower support member having a support ring in contact with the periphery of said second surface of said charge-coupled device, and (2) An annular upper tensioning member having a tensioning portion in contact with said first surface of said charge-coupled device, said tensioning portion having a substantially rectangular aperture therethrough which exposes at least a portion of said charge-coupled device to photoelectrons from said cathode, said upper tensioning member being attached to said lower support member thereby securing said charge-coupled device therebetween, said support assembly being located on said annular support flange so that said exposed portion of said charge-coupled device is centered about said optical axes.

* * * * *